United States Patent [19]

Hars et al.

[11] 4,224,871

[45] Sep. 30, 1980

[54] MEANS FOR DISPLACING ELEMENTS BETWEEN UPRIGHT MACHINE FRAMES

[75] Inventors: Christoph Hars; Klaus Schirrich; Bodo Steinmeier, all of Bielefeld; Wilfried Tappe, Herford, all of Fed. Rep. of Germany

[73] Assignee: Fischer & Krecke, Bielefeld, Fed. Rep. of Germany

[21] Appl. No.: 911,000

[22] Filed: May 30, 1978

[30] Foreign Application Priority Data

May 31, 1977 [DE] Fed. Rep. of Germany ..... 2724531

[51] Int. Cl.[3] ..... B41F 3/46; B41F 13/44

[52] U.S. Cl. ..... 101/248; 100/68; 101/212; 74/544; 74/546; 74/547; 74/554; 74/555

[58] Field of Search ..... 100/168; 74/543, 544, 74/546, 547, 545, 552, 554, 555, 556, 548; 101/212, 181, 183, 182, 184, 247, 248

[56] References Cited

U.S. PATENT DOCUMENTS

| | | | |
|---|---|---|---|
| 1,051,737 | 1/1913 | Jackson | 101/182 |
| 1,950,289 | 3/1934 | Benson | 74/548 |
| 2,825,217 | 3/1958 | Byrd | 100/168 |
| 2,845,810 | 8/1958 | Sampson | 74/544 |
| 2,853,897 | 9/1958 | Loewy | 74/544 |
| 3,098,434 | 7/1963 | Lime | 101/248 |
| 3,146,452 | 8/1964 | Rose | 74/544 |
| 3,163,109 | 12/1964 | Stelling, Jr. | 101/248 |
| 3,174,357 | 3/1965 | Conklin | 74/556 |
| 3,331,318 | 7/1967 | Augustyn et al. | 101/248 |
| 3,817,173 | 6/1974 | Merbold et al. | 101/247 |

FOREIGN PATENT DOCUMENTS

| | | | |
|---|---|---|---|
| 281927 | 2/1915 | Fed. Rep. of Germany | 101/248 |
| 1047794 | 7/1959 | Fed. Rep. of Germany | 101/248 |
| 7129767 | 9/1972 | Fed. Rep. of Germany | 101/248 |

*Primary Examiner*—William Pieprz

*Attorney, Agent, or Firm*—Pollock, Vande Sande & Priddy

[57] ABSTRACT

Means for displacing elements, such as the rollers of printing machines, located between the upright frames of a pedestal machine. A rotatable drive shaft is supported in each of the frames parallel to the direction in which the displacement is to proceed, and is drive connected to the said elements. Adjusting shafts having hand wheels attached to their free ends and coupled to the drive shafts extend, when in working position, into the space between the upright frames. In rest position, they are displaceable out of said space, which is thereby cleared for access to the equipment.

8 Claims, 3 Drawing Figures

MEANS FOR DISPLACING ELEMENTS BETWEEN UPRIGHT MACHINE FRAMES

SUMMARY OF THE INVENTION

The invention concerns means for the adjustment of a working element arranged in a displaceable manner between two frames of a pedestal machine, with two rotatable drive shafts each supported in one of the frames parallel to the direction of displacement, and in drive connection with the working element in the region of the frames and a hand-wheel connected to each of the drive shafts.

BACKGROUND OF THE INVENTION

In Flexo-printing machines, printing machine consoles extend from both of the frames which carry the actual printing apparatus with color application roller, color squeeze-out roller and printing cylinder. This printing apparatus is movable longitudinally on the consoles against the force of a counter-pressure cylinder.

Up to now, this longitudinal displacement took place with the aid of drive shafts, e.g., spindles supported horizontally in the frames and consoles and drivably coupled to the printing apparatus, in both frames. In these prior art arrangements, a hand-wheel permitting manual adjustment of the printing apparatus is attached to the end of the drive shafts extending from the frames, resp. pedestals. Simultaneous turning of both hand-wheels produced fairly good and, for the purpose, sufficient synchronization of the adjusting movement. It is, however, a requirement for the simultaneous operation of the hand-wheels, that the width of the pedestals, resp. the distance between frames, not exceed the reach of human hands. This requirement, however, is not met by wide machines of the described type.

When both hand-wheels can no longer be turned simultaneously, it is possible to turn both hand-wheels alternately by an equal number of turns. This process, however, is tedious and inaccurate. It has therefore been suggested to connect the drive shaft in one frame by means of an angle-drive and an intermediate shaft extending to the opposite frame to a hand-wheel provided on the outside of said other frame, and then to connect the hand-wheel for the drive shaft in the other frame also to the outside of said other frame, so as to facilitate the operation of both hand-wheels simultaneously. The use of such an intermediate shaft is, however unsuitable since it impedes access to the inking device.

It is an object of the invention to provide a device for the adjustment of the working elements on the frames of machines of pedestal construction, operable simultaneously for both sides of the frame without impeding access to the machine.

According to the invention, this object is attained by means of adjusting shafts extending into the drive shafts, and carrying hand-wheels on their free ends. Preferably, the adjusting shafts are located on one axis, so that they are easily and simultaneously accessible by hand from a position between the hand-wheels.

According to a preferred embodiment of the invention, the adjusting shafts are movable from the working position between the frames into a rest position in which the space between the frames is entirely cleared.

Preferably, the adjusting shafts are mounted for axial displacement in the angle drive, so that, on displacement of the hand-wheels towards the outside, they emerge from the outside of the frames, yet clear the interior space between the frames.

According to another preferred embodiment, the adjusting shafts are capable of being telescoped.

On the other hand, the adjusting shafts can comprise a universal joint that is secure against rotation, at least in the working position, so that they can be folded down in their rest position. A displaceable shell which bridges the universal joint in working position can be provided on the adjusting shafts.

Further, the adjusting shafts can be designed as removable stub shafts, so they can be put aside after use. They can also be swingable within the angle drive by means of which they are connected to the drive shafts. Movability between working and rest positions can also be attained by other means, should this be desirable in a particular case.

Tapered, screw or worm gear drives are especially useful as angle drives, but any other drives capable of displacing a rotation can be used.

BRIEF INTRODUCTION TO THE DRAWINGS

Preferred embodiments of the invention will now be explained by means of the attached drawings, wherein.

DESCRIPTION OF PREFERRED EMBODIMENT

Figure 1:
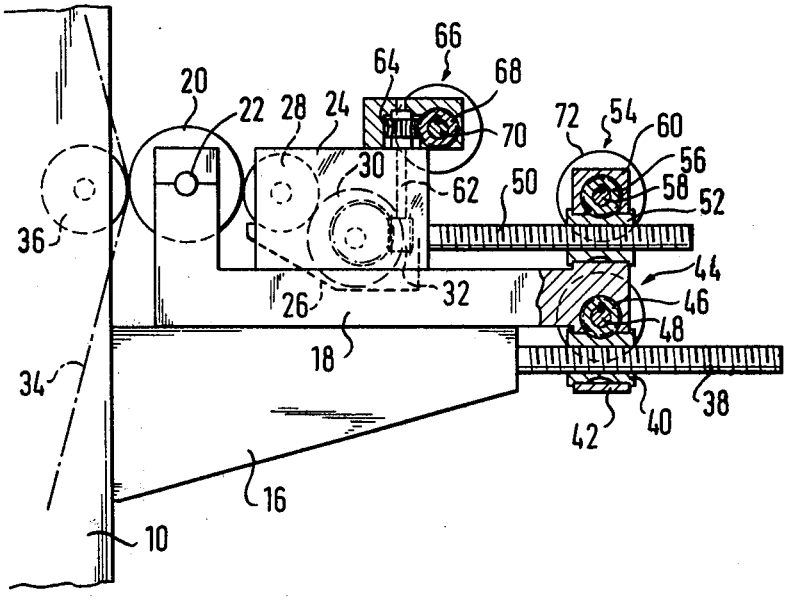
FIG. 1 shows a schematic, partially sectioned side view of a Flexo printing machine.

A machine stand 10 encloses two frames 12, 14 (FIG. 2) arranged side-by-side and having cantilevered inking device consoles 16 attached thereto. Pressure cylinder carriages 18 are arranged on these consoles for right- and left-ward displacement (in FIG. 1), and carry a pressure cylinder 20 in bearings 22. Mounted on pressure cylinder carriage 18 are inking device supports 24 which are also displaceable to the right or left. On the supports rests a color basin 26 above which are arranged a color application roller 28 and a color squeeze-out roller 30. Squeeze-out roller 30 can, for example, be pressed against color application roller 28 with the aid of an eccentric drive 32.

The printing ink is transmitted from the color application roller to plate- or pressure cylinder 20 and thence to a surface to be printed 34, which runs between pressure cylinder 20 and a counter-pressure cylinder 36.

Emerging from the consoles 16 towards the right (in FIG. 1), are drive shafts 38 that, in the example shown, are constructed as screwed spindles. These drive shafts are part of a mechanism about to be explained in greater detail, serving for the displacement of pressure cylinder carriages 18 on consoles 16 and, thence, forcing pressure cylinder 20 against counter-pressure cylinder 36. Drive shaft 38, constructed as a screw spindle, is surrounded by a nut 40 which is supported in a shoulder of pressure cylinder carriage 18 and represents the worm gear of a worm gear drive 44. Worm 46 of this worm gear drive is keyed onto an adjusting shaft 48 which is also supported within pressure cylinder carriage 18.

In a similar manner, a drive shaft 50, also formed as a screw spindle, is attached to the inking device support. Drive shaft 50 is surrounded by a nut 52 which again constitutes the worm gear of a worm gear drive 54, whose worm 56 is keyed into an adjusting shaft 58. Worm gear drive 54 and adjusting shaft 58 are supported in an upward directed shoulder 60 of pressure cylinder carriage 18.

The last-mentioned adjusting mechanism serves to force color application roller 28 against pressure cylinder 20.

Finally, the eccentric drive 32 has an upward-directed shaft 62 with a worm gear 64 which is part of a further worm gear drive 66. Corresponding worm 68 is keyed onto an adjusting shaft 70.

Worm gears 44, 54 and 66 make it possible to execute the required adjusting processes not from the front side of the machine (to the right in FIG. 1), but rather in a direction perpendicular thereto, from a position between frames 12 and 14 of the machine.

Figure 2:
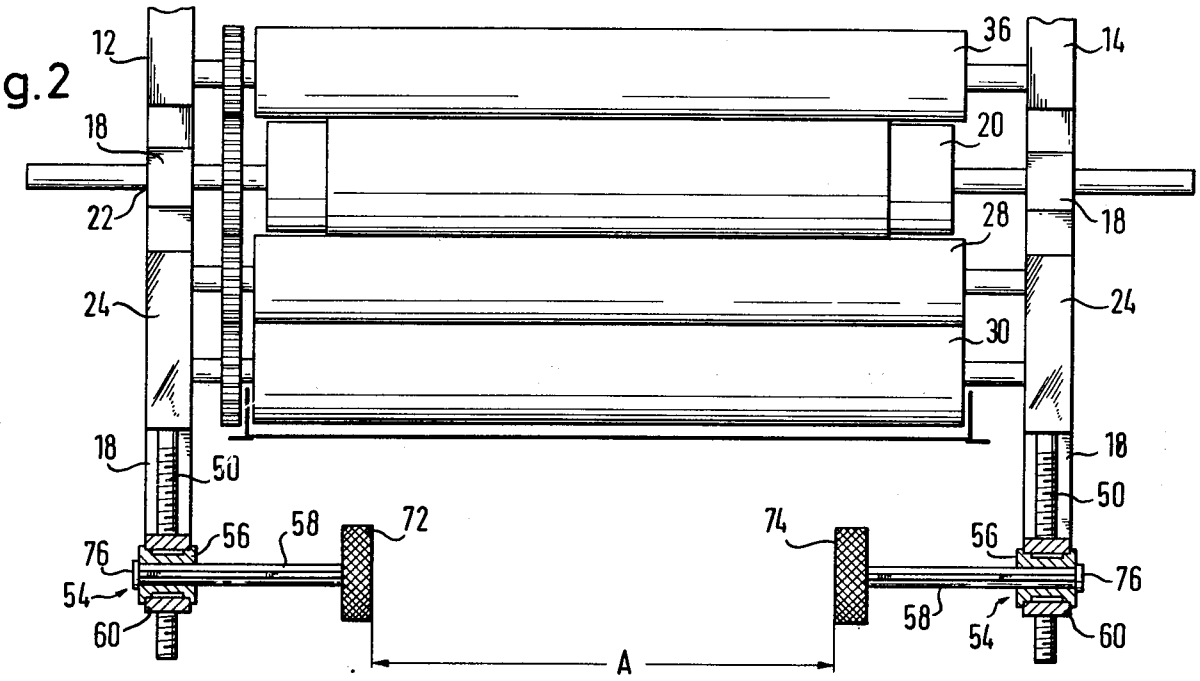
FIG. 2 is a partially sectioned partial plan view of the Flexo printing machine of FIG. 1.
Figure 3:
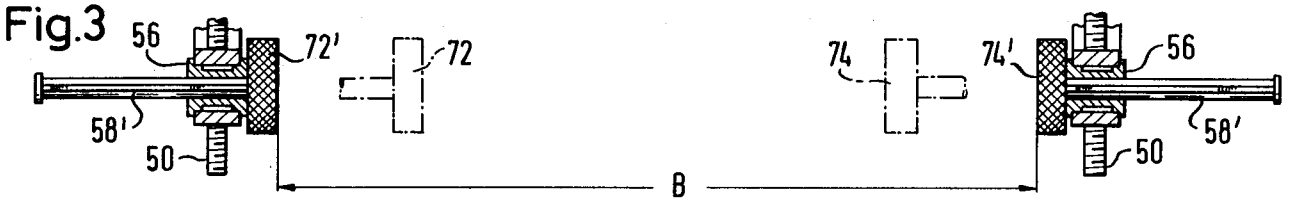
FIG. 3 is a partial view from FIG. 2, and shows a different position of the components.

FIGS. 2 and 3 illustrate merely the adjusting mechanism for displacement of inking device support 24 on pressure cylinder carriage 18. The remaining adjusting mechanisms are, however, constructed correspondingly.

Inking device supports 24 and drive shafts 50 connected thereto can be seen in plan view in FIG. 2. Drive shafts 50 are connected via worm gear 54 to adjusting shafts 58 which are aligned with each other and point towards the interior side of frames 12 and 14. Attached to the free ends of adjusting shafts 58 are hand-wheels 72 and 74. The adjusting shafts 58 are axially displaceable in worms 56, but are fixed in their rotating direction by means of a keyed tooth system or the like. On the outer ends of adjusting shafts 58, flanges 76 are provided as stops. In the working position shown in FIG. 2, hand-wheels 72 and 74 are located at a distance A which permits a simultaneous operation by an operator standing between them. FIG. 3 shows the hand-wheels, in dot-dash lines, in the working position of FIG. 2, as well as, in solid lines, in the rest position of the adjusting shafts and the hand-wheels, identified as 58', 72' and 74'. In this rest position, the intermediate space B between frames 12 and 14 is entirely clear, so that the color printing mechanism is readily accessible.

As has already been mentioned, it is also possible to move hand-wheels 72 and 74 with the adjusting shafts 58 out of working position in a manner other than that shown in FIGS. 2 and 3. For example, adjusting shaft 58 can be formed as a telescope, or it can have a universal joint adjacent to worm 56 which, if required, can be blocked by a displaceable sleeve (not shown) which maintains the adjusting shaft in its working position. The universal joint facilitates swinging of adjusting shaft 58 in a downward direction or into a separate holding device (not shown). Further, adjusting shaft 58 can be adapted to be removed from worm 56 and laid aside or supported by a suitable holder.

The hand-wheels can be connected to scales that permit a numerically reproducible adjustment. Also, a disconnecting coupling can be provided between hand-wheels and angle drives, permitting zero-adjustment in any optional position.

The adjusting shafts need not be aligned with each other. They can, for example, in the case of color mechanisms located high on the machine, slope downwardly or, in the case of color mechanisms located low on the machine, slope upwardly or at a forward angle directed to a suitable working position.

It is entirely possible to equip the adjusting mechanism according to this invention, especially in the case of heavy machines, with a servo-support.

Preferably, the adjusting rotation of the opposed hand-wheels is so designed that, upon absolutely equidirectional rotation of the adjusting shafts, an equidirectional displacement movement is caused. As a supplement to this invention, it is thus possible to connect the aligned and opposite adjusting shafts with a removable, turning movement transferring shaft, so that, for example, the hand-adjustment is executed at one side of the machine or in any desirable location between the machine frames for both side simultaneously.

If desired, flanges 76 can also be formed as hand-wheels permitting adjustment from the outside, especially by use of a connecting shaft between adjusting shafts 58.

What is claimed is:

1. Means for the adjustment, in a direction substantially perpendicular to its longitudinal axis, of a working element displaceably arranged between the two frames of a pedestal machine spaced from one another by a distance greater than the reach of a human's hands, comprising (a) two rotatable drive shafts that are each mounted on one of said frames parallel to the displacement direction, and operatively coupled to the respective longitudinal ends of said working element within the area of said frames;

(b) two adjusting shafts each having a free end extending into the space between said frames but outside the area of adjustment of said working element, and each coupled by means of angle drives with one of said drive shafts, said adjusting shafts being movable from their working position in which they extend toward one another in substantially the same vertical plane into the space between said frames to a rest position in which they are substantially clear of said space; and (c) a hand-wheel attached to said free ends of each of said adjusting shafts;

(d) whereby simultaneous adjustment of said working element for both sides of said frame can be made by a single operator during operation of said machine, while access to the space is made available when the machine is at rest.

2. Means according to claim 1, wherein said adjusting shafts are axially displacable in said angle drive.

3. Means according to claim 1, wherein said adjusting shafts can be collapsed telescopically.

4. Means according to claim 1, wherein said adjusting shafts comprise at least one rotationally solid universal joint.

5. Means according to claim 4, including a displaceable sleeve carried by said adjusting shafts for blocking said universal joint.

6. Means according to claim 1, wherein said adjusting shafts comprise removable stub shafts.

7. Means according to claim 1, wherein said adjusting shafts are swingably mounted in said angle drive.

8. Means according to claim 1, including a removable connecting shaft coupling corresponding opposed aligned adjusting shafts solidly in respect of rotation.

* * * * *